US006578628B1

(12) United States Patent
Garosshen

(10) Patent No.: US 6,578,628 B1
(45) **Date of Patent: *Jun. 17, 2003**

(54) ARTICLE EXHIBITING INCREASED RESISTANCE TO GALVANIC CORROSION

(75) Inventor: Thomas J. Garosshen, Glastonbury, CT (US)

(73) Assignee: Carrier Corporation, Syracuse, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 871 days.

(21) Appl. No.: 08/734,146

(22) Filed: Oct. 21, 1996

(51) Int. Cl.[7] ..... F28F 19/06
(52) U.S. Cl. ..... 165/133; 165/134.1
(58) Field of Search ..... 165/133, 134.1; 428/933

(56) References Cited

U.S. PATENT DOCUMENTS 3,678,242 A * 7/1972 Bennett ..... 219/118
3,718,961 A * 3/1973 Harper ..... 29/191
4,170,221 A * 10/1979 Gavin ..... 165/171 X
4,410,036 A * 10/1983 Kanada et al. ..... 165/134.1
4,733,331 A * 3/1988 Chauvet ..... 165/80.4 X
5,042,574 A * 8/1991 Cottone et al. ..... 165/133
5,131,463 A * 7/1992 Zimmerli et al. ..... 165/119
5,137,067 A * 8/1992 Espeut ..... 165/133
5,292,595 A * 3/1994 Yamauchi et al. ..... 428/654
5,554,234 A * 9/1996 Takeuchi et al. ..... 148/551

FOREIGN PATENT DOCUMENTS

GB 2284882 A 6/1995

OTHER PUBLICATIONS

Dissertation on Galvanic Corrosion of AI Alloys found on internet at http://www.metalogic.be/MatWeb/reading/mat-–cor/al_bim.htm, Sep. 1995. This document was "last modified" Sep. 22, 1995 according to Alta Vista.*

* cited by examiner

*Primary Examiner*—Allen Flanigan

(57) ABSTRACT

An article comprised of dissimilar metals in contact with one another wherein the exposed surface of the more noble metal is coated with a metal more galvanically compatible with the less noble metal. The article exhibits increased resistance to galvanic corrosion.

2 Claims, 1 Drawing Sheet

ARTICLE EXHIBITING INCREASED RESISTANCE TO GALVANIC CORROSION

TECHNICAL FIELD

This invention relates generally to protecting metals from a corrosive environment, and more specifically to protecting copper-aluminum heat exchangers for use in air conditioners.

BACKGROUND ART

Galvanic corrosion occurs when two dissimilar metals make contact with one another in the presence of an electrolyte thereby forming a galvanic couple. The more noble metal (higher on the galvanic series) provides the surface area for the reduction reaction and the less noble metal (lower on the galvanic series) corrodes in an oxidation process. The oxidation occurs in the greatest amount at the interface of the two metals but may also occur at some distance away from the actual interface. In coastal regions, the most common electrolyte is salt water in the air. A fine salt water mist may be blown inland for up to fifty miles from the coast. Sulfur dioxide from industrial pollution also creates an electrolyte when it combines with moisture in the air.

A common method of preventing galvanic corrosion has been to coat the exposed surfaces of the metals with various types of paint. These protective coatings have met with only limited success for a number of reasons. The main problem with coatings is that their effectiveness at preventing corrosion is degraded by exposure to the environment such as ultraviolet light and acid rain. Another common problem is that the coating materials often do not adhere well to the metal substrates and eventually flake off or erode away exposing the metal substrates. Moreover, such protective coatings are somewhat porous and allow the electrolyte to penetrate the surface of the substrates and connect the galvanic couple. In addition, the application of protective coatings to the surfaces of certain articles can negatively affect their performance.

Attempts have been made, with varying degrees of success, to coat conventional copper-aluminum heat exchangers with various materials in an effort to extend the useful life of the unit. These coating materials oftentimes reduce the heat transfer capability of the unit, exhibit poor adhesion properties and fail to penetrate into all the areas that might be exposed to a hostile environment.

DISCLOSURE OF INVENTION

In general the present invention provides an advanced galvanic corrosion protection method. In accordance with the present invention, in an article made of two metals, one being more noble than the other, the outer surface of the more noble metal is treated with a metal which is galvanically compatible with the less noble metal to form a protective layer between the two dissimilar metals which prevents the reduction reaction of the galvanic couple from occurring. The invention greatly reduces the oxidation reduction process which occurs when two dissimilar metals are in contact with one another in the presence of an electrolyte.

BEST MODE FOR CARRYING OUT THE INVENTION

Figure 1:
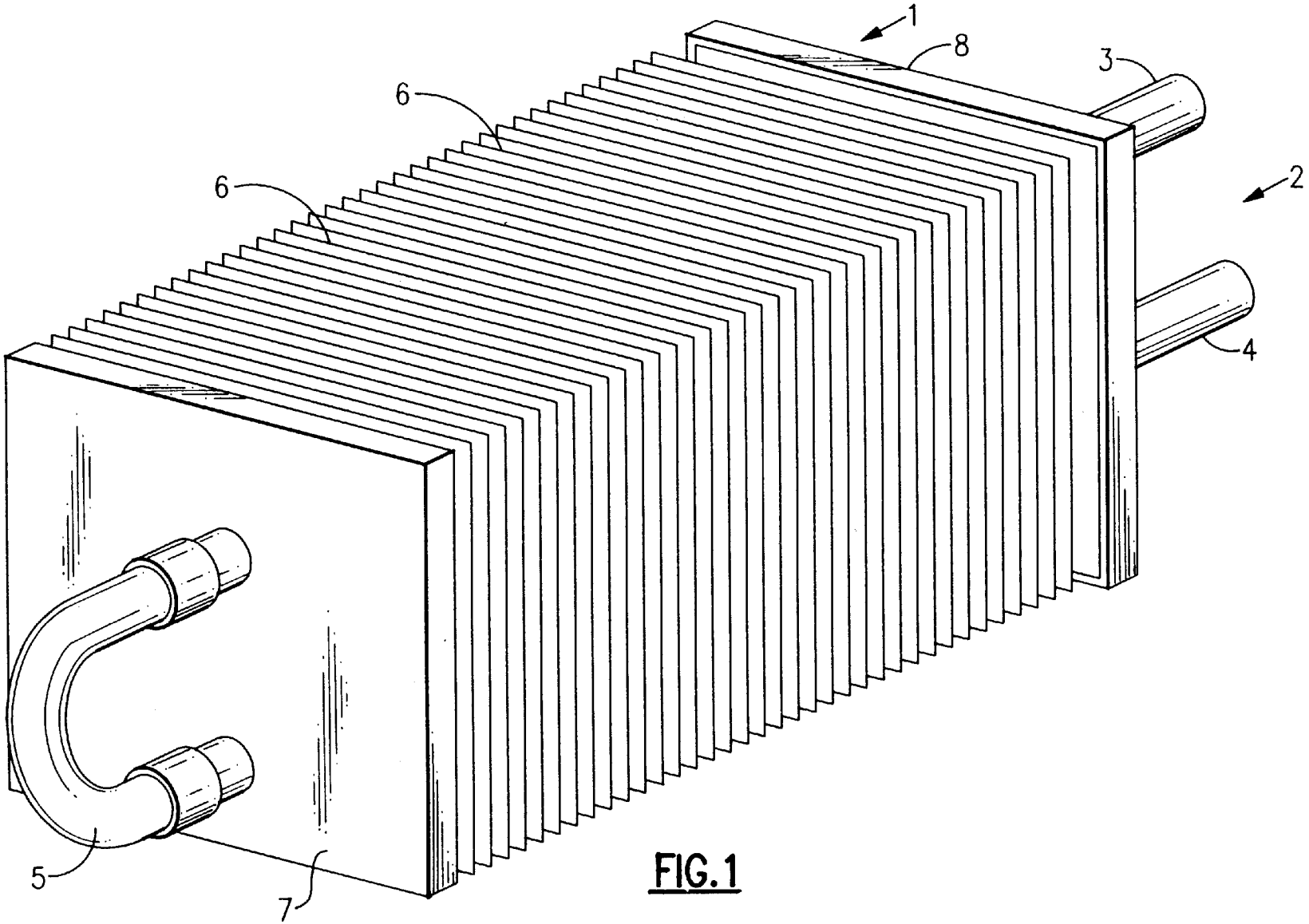
FIG. 1 is a perspective view of a heat exchanger incorporating heat exchanger tubes treated in accordance with the present invention.

As will be described in detail below the present invention will be described in to providing for galvanic corrosion protection of a copper-aluminum heat exchanger. However, it should be evident to one skilled in the art that the present invention is not limited to this specific example and could be used in connection with a number of arrangements where dissimilar metals are in contact with one another in the presence of an electrolyte.

FIG. 1 illustrates a fin/tube heat exchanger 10 of the type typically used in air conditioning units. The heat exchanger includes one or more flow circuits for carrying refrigerant through the heat exchanger unit. For the purposes of explanation, the heat exchanger 10 contains a single flow circuit tube 2 consisting of an inlet line 3 and an outlet line 4 which are connected at one end of the heat exchanger 10 by means of a 90° tube bend 5. It should be evident, however, that more circuits may be added to the unit depending upon the demands of the system. The unit further includes a series of fins 6 comprising radial disposed plate like elements spaced along the length of the flow circuit. The fins 6 are supported in the assembly between a pair of end plates 7 and 8 to define a gas flow passage through which a gas passes over the extension of the tube 2 and between the spaced fins 6.

As noted above, heat exchangers of this type are commonly exposed in use to corrosive environments. In a typical arrangement heat exchangers of this type are fabricated utilizing copper tubes for the circuit flow tubes and aluminum for the fins. The fins are disposed in contact with the tubes and draw heat away from the tubes through conductive heat transfer and then dissipate the heat through convective heat transfer to the gas (commonly air) flowing over the tubes. Copper is utilized in tube construction because of its good heat transfer properties, general resistance to corrosion, and ease of repair. The fins are fabricated from aluminum because of its good heat transfer properties, ease of fabrication, and low cost. Heat exchangers fabricated entirely from copper, as well as entirely from aluminum, are utilized in certain applications to avoid the problems of galvanic corrosion but at the cost of trades characterized above.

Aluminum is significantly lower on the galvanic series, i.e. less noble, than copper. It is for this reason that the aluminum oxidizes or corrodes when it is in contact with copper in the presence of an electrolyte. In the arrangement shown in FIG. 1, the interface of the tube and fin is where the galvanic couple is made and where the corrosion of the aluminum fins occurs. Once the fin has corroded at the intersection the fin is no longer in contact with the tube and thus the heat exchanger efficiency is greatly reduced because the fin loses its ability to conduct heat away from the tube.

As will be explained in greater detail below, in accordance with the present invention the exposed surfaces of the tubes 2 are coated or enriched with aluminum or a metal more galvanically compatible with aluminum. Aluminum is the best candidate material since a galvanic couple will not form between the aluminum coating and the aluminum fins 6. However, such active metals such as zinc, tin magnesium, gallium, cadmium and lead will also reduce the extent of the galvanic couple and thus the rate of oxidation of the fin material.

The coating or surface enrichment of the copper tubes 12 with aluminum is accomplished prior to the assembly of the heat exchanger 10. The aluminizing of copper is a well known practice and can be accomplished to a degree precision so as to virtually eliminate the above cited problems with conventional coating for corrosion protection. Several processes for aluminizing the copper tubes are known in industry and contemplated by the present invention. The coating processes include hot dipping, electroplating, aluminum filled painting and slurries, and thermal spraying. The surface enrichment processes include ion vapor deposition, chemical vapor deposition, and physical vapor deposition.

The critical aspect of the present invention is the production of a uniform coating of aluminum over the entire surface of the flow circuit tubes 2. Regardless of the process contemplated the variables of tube surface preparation, tube preheat temperature, coating composition, and coating thickness must be carefully controlled to achieve the proper results of the present invention. The preparation of the exposed surfaces of the tube is preferred to remove the surface oxide layer from the copper to ensure that the coating material will adhere well to the tube. A number of surface preparation processes are known in industry and include the use of reducing gases, fluxes and shot blasting. The tube preheat temperatures should be controlled between 24 C. and 600 C. to prevent the dissolution of copper and to limit intermetallic growth during the coating process.

It is preferred that the coating have high ductility to allow for the subsequent assembly of the heat exchanger without damaging the coating. The ductility of the coating is determined in part by the coating composition and the thickness of the coating. As mentioned above any metallic composition more galvanically compatible with the fin material than the tube material would slow the oxidation rate of the fins 6, while the ideal coating material would exactly match the fin material. Certain aluminum alloys are considered for use in the present invention and they comprise aluminum combined with silicon and aluminum combined with zinc. The coating must be thick enough to prevent the penetration of the electrolyte. However, as any coating has a somewhat negative effect on the heat transfer of the unit, excessively thick protective layer should be avoided. The optimal range of thickness contemplated by the present invention is 0.1 mils to 2 mils.

What is claimed is:

1. A heat exchanger exhibiting resistance to galvanic corrosion, comprising:

a fin collar formed from a first metal; and a tube connected with said fin collar at a contact area said tube formed from copper, said copper substantially more noble than said first metal, such that direct contact between said first metal and said copper in the presence of an electrolyte would lead to galvanic corrosion, and having a surface which is substantially treated with a contact material prior to the correction of said tube with said fin collar, said contact material located at least in the location of said contact area and comprising a third metal galvanically compatible with said first metal, wherein said contact material contacts said fin collar and prevents contact between said surface of said tube and said fin collar for substantially preventing galvanic corrosion of said fin collar relative to said tube.

2. A heat exchanger exhibiting resistance to galvanic corrosion comprising:

a fin collar formed from aluminum; and a tube connected with said fin collar at a contact area, said tube formed from copper, said copper substantially more noble than said aluminum, such that direct contact between said aluminum and said copper in the presence of an electrolyte would lead to galvanic corrosion, and having a surface which is substantially treated with a contact material prior to the connection of said tube with said fin collar, said contact material located at least in the location of said aluminum metal, wherein said contact material contacts said fin collar and prevents contact between said surface of said tube and said fin collar for substantially preventing galvanic corrosion of said fin collar relative to said tube.

* * * * *